US011898552B2

(12) United States Patent
Jun et al.

(10) Patent No.: US 11,898,552 B2
(45) Date of Patent: Feb. 13, 2024

(54) METHOD AND SYSTEM FOR PREDICTING FAILURES OF SUCKER ROD PUMPS USING SCALED LOAD RATIOS

(71) Applicants: SK INVESTMENT CO., LTD., Seoul (KR); SK EARTHON CO., LTD., Seoul (KR); Seoul National University R&DB Foundation, Seoul (KR)

(72) Inventors: Jongyoung Jun, Seoul (KR); Yeonjun Park, Gyeonggi-do (KR); Ha Eun Kim, Gyeonggi-do (KR); Hoonyoung Jeong, Seoul (KR); Byunggun Oh, Gyeonggi-do (KR); Yeongju Kim, Seoul (KR)

(73) Assignees: SK INVESTMENT CO., LTD.; SK EARTHON CO., LTD.; Seoul National University R&DB Foundation

( * ) Notice: Subject to any disclaimer, the term of this patent is extended or adjusted under 35 U.S.C. 154(b) by 158 days.

(21) Appl. No.: 17/403,806

(22) Filed: Aug. 16, 2021

(65) Prior Publication Data

US 2023/0057264 A1 Feb. 23, 2023

(51) Int. Cl.

| | |
|---|---|
| ***F04B 51/00*** | (2006.01) |
| ***E21B 47/008*** | (2012.01) |
| ***F04B 47/00*** | (2006.01) |
| ***F04B 49/06*** | (2006.01) |

(52) U.S. Cl.

CPC ..... *F04B 51/00* (2013.01); *E21B 47/008* (2020.05); *F04B 47/00* (2013.01); *F04B 49/065* (2013.01)

(58) Field of Classification Search

None

See application file for complete search history.

(56) References Cited

U.S. PATENT DOCUMENTS 3,838,597 A * 10/1974 Montgomery ..... E21B 47/12 417/1

4,509,901 A 4/1985 McTamaney et al.

(Continued)

FOREIGN PATENT DOCUMENTS

CN 108805215 A 11/2018

*Primary Examiner* — Lina Cordero

(74) *Attorney, Agent, or Firm* — Bracewell LLP; Brad Y. Chin

(57) ABSTRACT

A system and method for predicting failures of rod pumps using a scaled load ratio is configured to: optimize the size of a rolling window, the upper and lower bounds of the normal range of the scaled load ratio, an alert period, and an alert frequency ratio; receive data of a current maximum/minimum loads on a surface rod, and a current speed; remove outliers showing an abnormality; scale the current maximum/minimum loads on the surface rod using the maximum/minimum loads on the surface rod in normal operation; calculate a scaled load ratio; calculate the average of scaled load ratios in the rolling window; determine whether the average of scaled load ratios is in the normal range, and classify the values as normal and abnormal events; calculate the ratio of the abnormal events in the alert period, and generate an alert when the calculated ratio exceeds the alert frequency ratio; and monitor a pump state using the pump failure prediction system.

20 Claims, 4 Drawing Sheets

(56) References Cited

U.S. PATENT DOCUMENTS

| | | | | |
|---|---|---|---|---|
| 11,619,225 | B2 * | 4/2023 | Yang | G06T 11/206 702/183 |
| 2012/0025997 | A1 | 2/2012 | Liu et al. | |
| 2015/0275651 | A1 * | 10/2015 | Chen | E21B 47/009 702/6 |
| 2016/0076535 | A1 * | 3/2016 | Clifton | F04B 49/065 73/168 |
| 2017/0016313 | A1 * | 1/2017 | Pons | G05D 7/0676 |
| 2017/0037845 | A1 * | 2/2017 | Al Assad | F04B 51/00 |
| 2017/0268500 | A1 * | 9/2017 | Al Assad | F04B 47/026 |
| 2020/0392833 | A1 | 12/2020 | Sengul et al. | |
| 2022/0178365 | A1 * | 6/2022 | Yang | F04B 49/065 |

* cited by examiner

METHOD AND SYSTEM FOR PREDICTING FAILURES OF SUCKER ROD PUMPS USING SCALED LOAD RATIOS

BACKGROUND OF THE INVENTION

Field of the Invention

The present disclosure relates to a method and system for predicting a failure of a rod pump and, more particularly, to a method and system for predicting a failure of a sucker rod pump using scaled load ratios at the surface rod of the sucker rod pumps.

Description of the Related Art

A sucker rod pump (hereafter, briefly referred to as a 'rod pump' or a 'pump') is one of common artificial lift systems that increases the productivity of depleted oil wells that do not have sufficient bottomhole pressures. A rod pump lifts up underground liquid (e.g., oil) up to the ground using a rod pump. However, a rod pump may have failures in operation because of various reasons such as fluid pound, gas interference, worn pump, plunger tagging, and so on.

It is not practical to manually monitor and manage hundreds of rod pumps within limited manpower and budget. If pumps are not managed or repaired properly in time, substantial financial losses occur because of the permanent failure of the pumps and the decrease in oil production.

One of the most common ways to diagnose pump failures is to analyze the shape of downhole pump cards, which are also called dynamometer cards. A pump card is a plot of locations and rod loads in a pump stroke, which correspond to the x-axis and y-axis, respectively. Surface pump cards are measured and obtained at the surface, and then downhole pump cards are calculated using the surface pump cards and the specification of the pump.

The automatic classification of the shape of downhole pump cards has been researched to detect pump anomalies. For example, a method that classifies the state of a pump by individually analyzing four sides of such a downhole pump card; an artificial neural network model that finds out data having high relevance to pump failures by analyzing pump data such as a rod load and bottomhole pressure; a method that classifies the abnormal states of a pump using a convolutional neural network (CNN) classifying downhole pump card images; a method that classifies the abnormal states of a pump for various machine learning models such as a gradient boosted machine and a random forest classifier; a method that reduces the order of a downhole pump card using the Fourier series and classifies the state of a pump by inputting the pump card to an artificial neural network; etc. have been developed.

Further, a research for optimally operating a pump has been conducted. In particular, an algorithm that enables to operate pumps efficiently using a variable motor speed has been developed. An algorithm that presents a pump speed, a stroke length, a pump specification change using the relationship between an output and a pump speed in real-time data also has been introduced.

However, the detection of pump anomalies using the classification of downhole pump cards does not lead to accurate prediction of pump failures. Even though a pump is in an abnormal state, the pump may work without any failure for months. The classification of downhole pump cards provides operators with only the current state of a pump, not when the pump fails. Moreover, it is difficult to deal with all of pump anomalies because of limited manpower and budget. Predicting and handling critical pump failures is more practical rather than all of pump anomalies. A new method is needed to predict pump failures before the pump failures occur.

DOCUMENTS OF RELATED ART (Patent Document 1) CN 108805215 A
(Patent Document 2) US 2012/0025997 A1

SUMMARY OF THE INVENTION

An objective of the present disclosure is to provide a method and system for predicting failures of rod pumps using scaled load ratios at the surface rod of the sucker rod pumps.

In order to achieve the objectives, according to an embodiment of the present disclosure, there is provided a method of predicting failures of rod pumps using scaled load ratios.

The method according to an embodiment includes: optimizing the size of a rolling window, upper and lower bounds of a normal range of the scaled load ratio, an alert period, and an alert frequency ratio as optimal input values through an optimization module constituting software; receiving data of a current maximum load on a surface rod, a current minimum load on the surface rod, and a current speed of a target oil well pump from a storage device by means of a processor of a pump failure prediction system; removing outliers showing an abnormality of the received data on the basis of an outlier removable reference set using the outlier removable module constituting the software that is executed by the processor; receiving data of maximum and minimum loads on the surface rod in normal operation from the storage device and scaling the maximum and minimum loads by means of the processor; calculating scaled load ratios using the scaled load ratio calculation module constituting the software for the data excluding outlier data; calculating the average of scaled load ratios in the rolling window method using the scaled load ratio through average value calculation module constituting the software by applying a rolling window method to remove noises of the calculated scaled load ratios; determining whether the average of scaled load ratios is in the normal range, and classifying values as normal or abnormal events using the scaled load ratio-normal range determination and classification module constituting the software; calculating the ratio of abnormal events and generating an alert when the calculated ratio exceeds the alert frequency ratio using the failure data ratio calculation and alert generation module constituting the software; and monitoring a pump state using the pump failure prediction system to accurately determine the pump state using the scaled load ratios, a pump speed, a pump card, and a pump Pillage.

In an embodiment, wherein the optimization is performed when the size of the rolling window, the upper and lower bounds of the normal range of the scaled load ratio, the alert period, and the alert frequency ratio are initially set as optimal initial input values, or is performed when the input values need to be more optimal, for example, when the rod pump is reinstalled, repaired, or replaced.

In an embodiment, the size of the rolling window, the upper and lower bounds of the normal range of the scaled load ratio, the alert period, and the alert frequency ratio that are the optimal input values set using the optimization module may be stored in the storage device.

In an embodiment, a Matthews Correlation Coefficient (MCC) that is an index for evaluating analysis performance may be used in an objective function that is used for optimization during the optimizing, and MCC may be calculated by Equation 3 to be described below.

In an embodiment, the modified MCC that gives a weight to the TP (true and positive) term may be applied instead of the original MCC in Equation 3 to enhance the pump failure prediction performance of the optimization module. The modified MCC gives a weight of 5 to the TP in Equation 4. In the modified MCC, for a single pump failure event, if TP (True and Positive) data, which mean correct predictions for pump data points after the pump failure event, take more than 10% of the entire pump data points after the pump failure event, this is considered as an effective alert for the single pump failure event, and all the data points under the pump failure event are considered as TP regardless of the prediction results.

In an embodiment, as for the alert period, a range of 0.1 day to 14 days may be designated as a search target at the early stage of attempting optimization, or the period of pump data acquisition is a good reference value for the alert period. For example, if pump data are acquired every day, 1 day may be set as the alert period, but the alert period can be optimized to improve the prediction performance of pump failures.

In an embodiment, for the data of the maximum load on the surface rod in normal operation and the minimum load on the surface rod in normal operation, average values for about 2 weeks of a production period that is stably maintained may be used, depending on target oil well fields, or theoretical maximum/minimum values in normal operation may be used when there are target oil well, pump, and production liquid.

In an embodiment, the scaled load ratio is calculated using scaled load ratio calculation Equation (1) and (2) to be described below.

To achieve the objectives, according to an embodiment of the present disclosure, there is provided a system for predicting failures of a rod pump using scaled load ratios.

The system according to an embodiment includes: a storage device storing all data in the system (e.g. current maximum/minimum loads on a surface rod, a current pump speed obtained from a sensor installed at the rod pump, scaled load ratios, the average of scaled load ratios in a rolling window, the ratio of abnormal events, the size of a rolling window, upper and lower bounds of a normal range of the scaled load ratio, an alert period, and an alert frequency ratio, and so on); and a processor executing the software using data stored in the storage device, in which the software predicts whether the rod pump has an abnormality by calculating a scaled load ratio on the basis of the data of current maximum/minimum loads on the surface rod stored in the storage device and data of maximum/minimum loads on the surface rod in normal operation.

In an embodiment, the software may include an outlier removable module configured to remove outliers showing an abnormality of data received by the processor from the storage device on the basis of a set outlier removal reference.

In an embodiment, the software may include a scaling module configured to receive data of maximum/minimum loads on the surface rod input and stored in the storage device by an operator, and to scale the data into normal operation values.

In an embodiment, for the data of the maximum/minimum loads on the surface rod in normal operation, average values for about 2 weeks of a production period that is stably maintained may be used, depending on target oil well fields, or theoretical maximum/minimum values in normal operation may be used when there are target oil well, pump, and production liquid.

In an embodiment, the software may include a scaled load ratio calculation module configured to calculate a scaled load ratio through a scaled load ratio calculation Equation (1) and (2) which will be described below using data that have undergone preprocesses such as outlier removal and scaling.

In an embodiment, the software may include a scaled load ratio average calculation module configured to calculate the average value of scaled load ratios in the rolling window by applying a rolling window method to the calculated scaled load ratio to remove the noises of the scaled load ratio.

In an embodiment, the software may include a scaled load ratio-normal range determination and classification module configured to determine whether the average of scaled load ratios is in the normal range, and classify the value as normal and abnormal events.

In an embodiment, the software may include a failure data ratio calculation and alert generation module configured to calculate the ratio of abnormal events in the alert period, and to generate an alert when the calculated ratio exceeds the alert frequency ratio.

In an embodiment, the software may further include an optimization module configured to optimize the size of the rolling window, the upper and lower bounds of the normal range of the scaled load ratio, the alert period, and the alert frequency ratio as optimal input values; the optimization is performed when the size of the rolling window, the upper and lower bounds of the normal range of the scaled load ratio, the alert period, and the alert frequency ratio are initially set as optimal initial input values, or is performed when the input values need to be more optimal, or the rod pump is reinstalled, repaired, or replaced; and the size of the rolling window, the upper and lower bounds of the normal range of the scaled load ratio, the alert period, and the alert frequency ratio that are the optimal input values set in the optimization module are stored in the storage device.

In an embodiment, an MCC that is an index for evaluating analysis performance may be used in an objective function that is used during optimization by the optimization module, and the MCC may be calculated by Equation 3 to be described below.

In an embodiment, the modified MCC shown in Equation 4 that gives a weight to the TP (true and positive) term may be used instead of the original MCC shown in Equation 3 during optimization by the optimization module to enhance the pump failure prediction performance of the optimization module. The modified MCC gives a weight of 5 to the TP in Equation 4. In the modified MCC, for a single pump failure event, if TP (True and Positive) data take more than 10% of the entire pump data points after the pump failure event, this is considered as an effective alert for the single pump failure event, and all the data points under the pump failure event are considered as TP regardless of the prediction results.

In an embodiment, as for the alert period, a range of 0.1 day to 14 days may be designated as a search target at the early stage of attempting optimization, or the period of pump data acquisition is a good reference value for the alert period. For example, if pump data are acquired every day, 1 day may be set as the alert period, but the alert period can be optimized to improve the prediction performance of pump failures.

The features and advantages of the present disclosure will be made clearer from the following detailed description based on accompanying drawings.

The terms and words used in the present specification and claims should not be interpreted as being limited to typical meanings or dictionary definitions, but should be interpreted as having meanings and concepts relevant to the technical scope of the present disclosure based on the rule according to which an inventor can appropriately define the concept of the term to describe most appropriately the best method he or she knows for carrying out the disclosure.

According to the present disclosure, the degree of damage to a pump and the possibility of a malfunction are considerably decreased by quickly and accurately predicting failures of the pump compared with the related art, and this leads to the reduction of the maintenance costs and time due to stop of production. Furthermore, it is possible to improve the productivity of an oil well and the stability of a pump by optimizing a pump speed.

BRIEF DESCRIPTION OF THE DRAWINGS

The above and other objectives, the features and advantages of the present disclosure will be more clearly understood from the following detailed description when taken in conjunction with the accompanying drawings, in which.

DETAILED DESCRIPTION OF THE INVENTION

Figure 1:
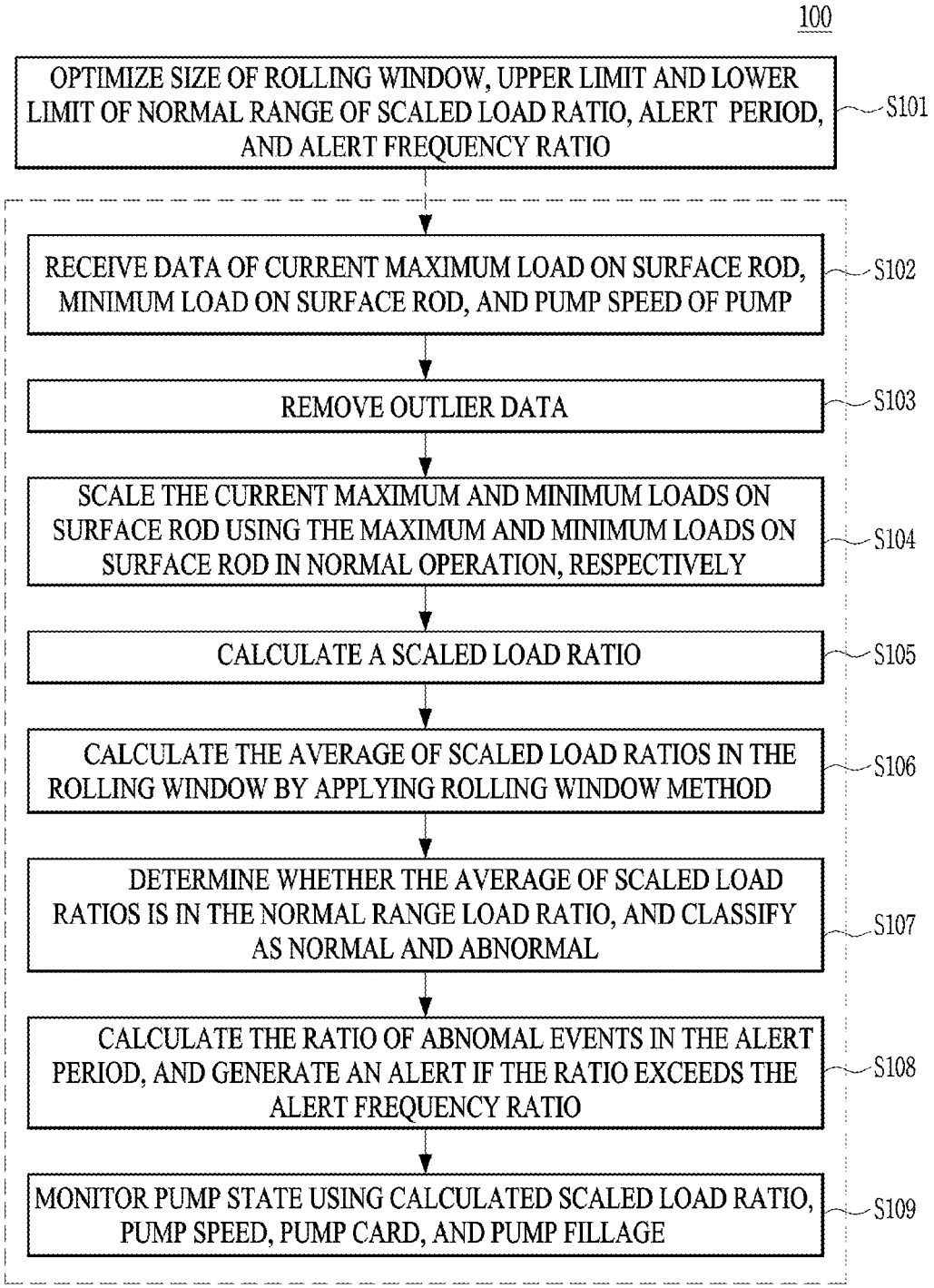
FIG. 1 is a flowchart showing a method of predicting failures of rod pumps using scaled load ratios according to an embodiment of the present disclosure.

The objects, advantages, features of the embodiments of the present disclosure will be made clear in the following description of the embodiments related to the accompanying drawings. It should be noticed that when reference numerals are given to components in the drawings in the specification, the same components are given the same number even if they are not shown in different drawings. In the specification, terms 'a surface', 'another surface', 'first', 'second', etc. are used to discriminate one component from another component and the components are not limited to the terms. Relevant well-known technologies that may unnecessarily make the point of embodiments of the present disclosure are not described in detail in the following description of the embodiments.

As used herein the terms "the," "a," or "an," mean "at least one," and should not be limited to "only one" unless explicitly indicated to the contrary. Thus, for example, reference to "a component" includes embodiments having two or more such components unless the context clearly indicates otherwise.

In general, downhole pump cards showing productivity, the position of a piston plunger and corresponding loads have been used to monitor sucker rod pumps at oil well fields. However, even though pump anomalies are detected in monitoring downhole pump cards, pumps may work without any failure. It is not practical to handle all of pump anomalies that are not directly related to pump failures under limited manpower and budget. The limited manpower and budget should be used to solve critical pump anomalies that can lead to pump failures. Accordingly, the applicant(s) has found an indicator named a scaled load ratio that represents the abnormality of the current pump state before a pump failure occurs.

34 temporal data sets of pump and production data that are collected from 76 oil wells during about two years were analyzed to find the indicator. The 34 temporal data sets of pump and production data consisted of 31 data sets with pump failures and 3 data sets without pump failures. Further, for the temporal data sets, the relation between pump failures and the pump and production data was analyzed such as a daily output, a choke pressure, a tubing pressure, a casing pressure, a downhole pump card, a pump fillage, a daily operation time ratio, a stroke length, a maximum load on the surface rod, a minimum load on the surface rod, a pump speed, etc. Meanwhile, the information about the 34 sections exemplified as the analysis target data may be changed, depending on the target oil wells, so the information is not stated in detail.

Principal Component Analysis (PCA) was mainly used for the analysis. Latent variables are extracted using PCA from the 34 temporal data sets, and the data sets are plotted in 3-dimensional spaces representing the latent variables where the time to the pump failure of each data point was colored.

Other than PCA, random forest, autoencoder, multi-dimensional scaling (MDS) using the Hausdorff distance were also used for the analysis. As a result, the maximum load on a surface rod, the minimum load on the surface rod, the pump speed, and the pump fillage showed high relevance to the pump failures in the analyses. Further, as the result of performing additional analysis on the four factors, it was observed that the maximum load on the surface rod and the minimum load on the surface rod are highly correlated to pump failures. For this reason, the applicant(s) has developed an invention for predicting pump failures using a scaled load ratio.

As will be described below, the scaled load ratio is a ratio obtained by dividing a minimum load ratio, which is the ratio of a minimum load applied to the surface rod of a pump to a value in a normal state, by a maximum load ratio, which is the ratio of a maximum load applied to the surface rod of the pump to a value in the normal state. The ratio in normal operation was 1, and the value of the load ratio when a pump failure occurs becomes farther from 1.

Other than the characteristic that the scaled load ratio goes away from 1, which is the value in the normal operation state, when a pump is close to an abnormal state, the load ratio has a characteristic of changing in accordance with the state of a pump. Representative factors that influence the scaled load ratio are the pump fillage and the pump speed.

Considering the scaled load ratio calculation Equation (1) to be described below, the scaled load ratio decreases when the minimum load on a surface rod increases or the maximum load on a surface rod decreases. Since the minimum load on a surface rod is a minimum load that is generated in a downward stroke, generally, it does not change in most cases. However, when the speed of a pump changes or the pump fillage changes, the maximum load on a surface rod sensitively reacts to the change even during common operation.

For example, when a pump speed decreases, the load on the surface rod decreases by the reduction of acceleration during ascending of the pump, so the load ratio has a value larger than that in the normal operation state. When the pump fillage decreases, light gas fills the inside of the pump, so the load due to liquid becomes smaller than when the fillage is high. This means reduction of the maximum load on a surface rod, which results in an increase of the load ratio. This feature may cause confusion with the load ratio that shows a change when coming close to an abnormality of a pump, but can be easily discriminated when the pump fillage and the pump speed are both monitored.

The scaled load ratio is affected by a downhole pressure depending on the height of liquid in an annulus, a change of the parts of a pump, a change of an installation depth, etc., other than the pump fillage and the pump speed. These factors are usually maintained as same values after a pump is initially started, so they influence the normal state operation value of the early stage. Accordingly, attention must be paid when setting a load on a surface rod in the normal state.

Hereafter, a method of predicting pump failures using a scaled load ratio on a surface rod of the rod pump is described with reference to FIG. 1.

A scaled load ratio is given in Equations 1 and 2 where the current minimum and maximum loads on the surface rod are the minimum and maximum loads in the current surface pump card. The scaled load ratio in the normal pump state is close to 1 in the present disclosure, and the normal range of the scaled load ratio should be optimized to achieve the accurate prediction of pump failures. The scaled load ratio becomes farther from 1 as the pump is in a more abnormal state. The calculation Equation of the scaled load ratio is as the following Equation (1) and (2).

$$\text{Scaled minimum load on surface rod} = \frac{\text{Current minimum load on surface rod}}{\text{Minimum load on surface rod in normal operation}} \quad (1)$$

$$\text{Scaled minimum load on surface rod} = \frac{\text{Current maximum load on surface rod}}{\text{Maximum load on surface rod in normal operation}}$$

the load ratio in Equation (1) can be expressed as the following Equation (2):

$$\text{Scaled load ratio} = \frac{\text{Scaled minimum load on surface rod}}{\text{Scaled maximum load on surface rod}} \quad (2)$$

If the scaled load ratio increases or decreases excessively over or under 1, that is the value in normal operation defined as described above, the pump is likely to be in an abnormal state and a pump failure may occur shortly.

However, even though the scaled load ratio goes out of the normal range a few times, the abnormal events should not be considered as critical problems because various exceptions in operation of rod pumps such as measurement errors and temporary operation changes make outliers and noises in the scaled load ratio data, and too frequent alerts cannot be reviewed. Thus, the abnormality of the scaled load ratio caused by outliers and noises should be mitigated. A minority of abnormal events that are out of the normal range should not be alerted.

For these reasons, scaled load ratio data are preprocessed, and pump failure alerts are generated based on the preprocessed data. First, outlier load data that are physically inappropriate are eliminated. Then scaled load ratios are calculated and averaged in a rolling window to mitigate the noise of the scaled load ratios. Even though the average of the scaled load ratios in the rolling window is out of the normal range, operators are alerted only when the frequency ratio of the abnormal events in a predefined alert period is greater than a predefined alert frequency ratio.

The size of a rolling window, an alert period, and an alert frequency ratio should be optimized to improve the accuracy of pump failure alerts. The upper and lower bounds of a normal range should be also optimized to enhance the prediction accuracy. The details of outlier elimination, data averaging, and optimization are described with reference to FIGS. 1, 4, and 5.

Figure 4:
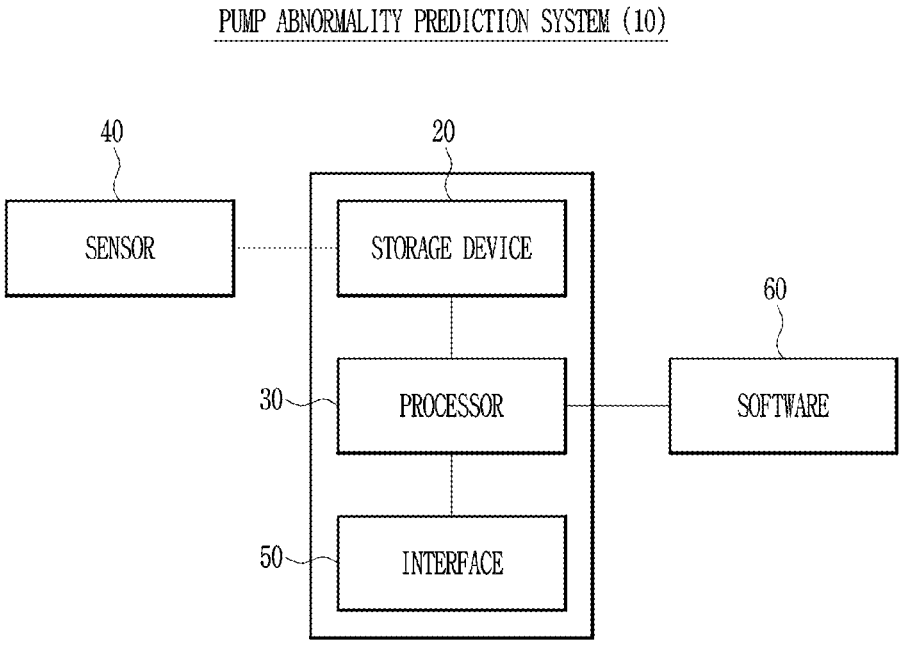
FIG. 4 is a block diagram showing a system for predicting failures of rod pumps using scaled load ratios according to an embodiment of the present disclosure.

First, in step S101 shown in FIG. 1, the size of a rolling window, the upper limit of a normal range of the average of scaled load ratio, the lower limit of the normal range of the average of scaled load ratio, an alert period, and an alert frequency ratio are optimized as optimal input values using the optimization module 67 (see FIG. 5) constituting software 60 that is executed by a processor 30 of a system 10 for predicting pump failures as shown in FIG. 4.

In the optimization module 67, the objective function should be a score that represents the performance of prediction of pump failures. The prediction results are classified as True-Positive (TP), True-Negative, (TN), False-Positive (FP), False-Negative (FN). TP means giving an alert in a specific period before an actual pump failure happens. The specific period can be a few weeks to a few months, and it depends on when an operator wants to be alerted before pump failures happen. TN, FP, and FN mean giving no alert when an actual pump failure does not happen, giving an alert when an actual pump failure does not happen, giving no alert when an actual pump failure happens, respectively. The objective function should be set so that the prediction results have more TP and TN, less FP and FN. The Matthews Correlation Coefficient (MCC) (Matthews, 1975) can used as the objective function. Non-gradient-based optimization algorithms such as particle swarm optimization (PSO) and pattern search are recommended.

The optimization step should be performed separately whenever the rod pump is reinstalled, repaired, or replaced. The optimal values of the size of a rolling window, the upper limit of the normal range of the average of scaled load ratios, the lower limit of the normal range of the average of scaled load ratios, the alert period, and the alert frequency ratio are stored in the storage device 20. Only the process (steps S102 to S109) indicated by a dotted line FIG. 1 is performed unless the optimal input values in step S101 are reset.

Accordingly, the optimization step is performed not every time the method of the present disclosure is performed, or can be selectively performed, if necessary, depending on situations.

Next, after the optimal input values are set in the optimization step (step S102), the processor 30 of the system 10 for predicting pump failures shown in FIG. 4 receives the current maximum and minimum loads on the surface rod, and the current pump speed data of a target oil well pump from the storage device 20 where a data collector (a sensor 40 in FIG. 4) save the data.

Figure 5:
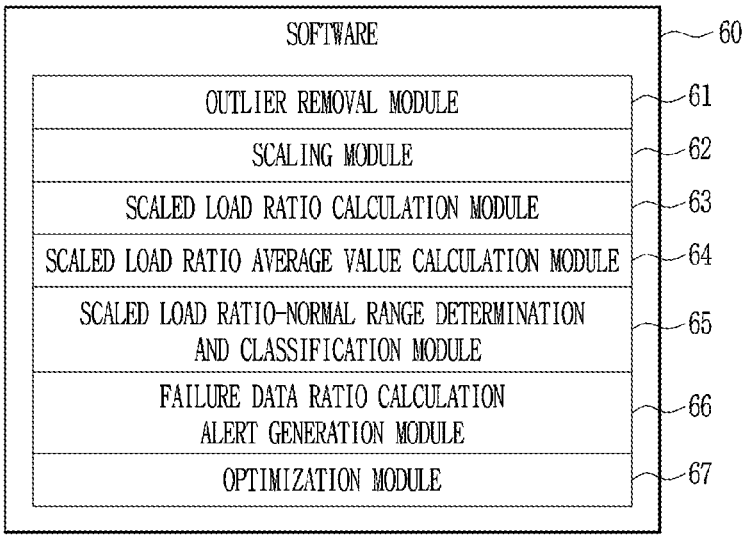
FIG. 5 is a diagram showing the modules constituting the software shown in FIG. 4 according to an embodiment of the present disclosure.

Next, in step S103, outlier data that are inappropriate physically are eliminated by the outlier removal module 61 of the software 60 shown in FIG. 5, and the outlier removal is executed by the processor 30 of the system 10. The reference criteria for outlier removal is as the following Table 1. The reference criteria for outlier removal shown in Table 1 should be modified to apply to other fields.

TABLE 1

| |
|---|
| pump speed < 3 |
| pump speed ≥ 10 |
| maximum load on surface rod or minimum load on surface rod = 0 |
| \|maximum load on surface rod − minimum load on surface rod\| < 100 |

Next, in step S104, the processor 30 receives maximum and minimum loads on a surface rod in normal operation from the storage device 20. The maximum and minimum loads on a surface rod in normal operation can be calculated by selecting or averaging maximum/minimum loads on a surface rod for weeks (e.g., 2 weeks) in normal operation. When the maximum and minimum loads on a surface rod in normal operation are input through an interface 50 shown in FIG. 4, the interface 50 can be a certain device that enables an operator to interact with the system 10 for predicting pump failures, such as a keyboard, a mouse, or a display (e.g., all displays including a touch screen).

The maximum and minimum loads on the surface rod are divided by the maximum and minimum loads on the surface rod in normal operation in the scaling module 62 in FIG. 5, respectively.

Next, in step S105, a scaled load ratio is calculated by a scaled load ratio calculation module 63 of the software 60 shown in FIG. 5 using Equation (2).

Next, in step S106, in order to remove noise from the scaled load ratio calculated as described above, an average value of scaled load ratio within the size of a rolling window is calculated by applying a rolling window technique to the calculated load ratio. The size of the applied rolling window may depend in the level of noise removal of data. The average value of a load ratio is calculated by a scaled load ratio average value calculation module 64 shown in FIG. 5 and constituting the software 60, and the calculated average value of the scaled load ratios is stored in the storage device 20.

The period that is applied to calculate the average value of a load ratio is not specifically limited, and an operator may set and apply an appropriate period in accordance with a target oil well of which an abnormality is predicted.

The size of a rolling window set through the optimization step S101 is involved with step S106 of calculating an average value of scaled load ratios by applying the rolling window method.

Next, in step S107, it is determined whether the average of scaled load ratios in the rolling window is in the normal range. If the average of scaled load ratios is in the normal range, then it is classified as normal, otherwise classified as abnormal, which means the probability of a pump failure is high. The upper and lower bounds of the normal range are optimized in the optimization step S101 to improve the performance of prediction of pump failures. Determining whether the average of the scaled load ratios is in the normal range and classifying the average of scaled load ratios are performed by a scaled load ratio-normal range determination and classification module 65 shown in FIG. 5.

All the data calculated or classified in the process are stored in the storage device 20 shown in FIG. 4, and can be applied to respective corresponding data, if necessary. Data that are stored in the storage device 20 are not limited to the data described above, and data input through the interface 50 by an operator (e.g., production data, pressure data, an operation note, and rod pump data for operating an oil well) and all data produced and obtained while operation is performed may be stored.

The upper limit/lower limit of the normal range of a scaled load ratio set in the optimization step S101 are used in step S107 of classifying values as the normal range values and abnormal range values.

Next, in step S108, the ratio of abnormal events in the alert period is calculated where the average of scaled load ratios of an abnormal event is not in the normal range. The ratio of abnormal events in the alert period is the number of abnormal events in the alert period over the number of total events (normal+abnormal events). An alert is generated if the ratio of the abnormal events exceeds the alert frequency ratio. The alert period and the alert frequency ratio are optimized in the optimization step S101 to improve the performance of prediction of pump failures.

Calculating the ratio of abnormal events in the alert period and generating an alert are performed by a failure data ratio calculation and alert generation module 66 shown in FIG. 5 and constituting the software 60. The alert can be delivered using a predetermined device (e.g., though not shown, a printer, a speaker, a display screen, or a data storage device) that communicates with the failure data ratio calculation and alert generation module 66 through a network (not shown).

The alert period and the alert frequency ratio set in the optimization step S101 are used in the alert generation step S108.

Finally, in step S109, the overall pump state is analyzed and monitored based on the results of the system 10 (e.g., average of scaled load ratios, ratio of abnormal events, alert) and other pump data (e.g., pump speed, pump card, pump fillage, and so on). The monitoring process is as follows.

An operator should check whether the number of data points in the rolling window and the alert period is high enough to predict the possibility of a pump failure. The number of data points is the number of pump cards. More data should be acquired if too many data are removed by the outlier removal module 61 shown in FIG. 5. If the number of data points is not sufficient, the operator should check if the pump works properly on the basis of pump speed and load data.

If the number of data points is high enough and an alert is generated, the operator should check if the fluid is over-pumped. If the fluctuation of the pump speed is high and the shape of the downhole pump card is classified as fluid pound, then the current pump status is regarded as over-pumping. The operator should reduce the pump speed. However, if the pump speed is stable, the pump state can be diagnosed using the change of the average of scaled load ratios and pump Pillages. This anomaly can be diagnosed as follows.

First, if the average of scaled load ratios changes steeply, the anomaly can be caused by worn pump. Second, if the average of scaled load ratios becomes out of the normal range gradually, and the pump fillage decreases gradually, then a plunger is likely to have a problem. If the pump speed, the pump fillage, and the production are stable, maintaining the current operation is recommended.

If it is determined that the number of data points for the updated period is enough, the pump state is applied in accordance with the calculation result. When a pump state predicted on the basis of a load ratio is normal, the system can be operated in the same state until the next monitoring, but when the pump state is failure, the operator checks whether the pump speed is constant.

As the result of checking the pump speed for the case of failure, when the pump speed has been changed (i.e., is not constant) and it is also determined that the pump card is a fluid pound, the operator decreases the pump speed through the pump-off controller (not shown). However, when the pump speed is constant, it means that most of scaled load ratios are also stable, so, in this case, it is checked whether the normal operation period used for scaling has been accurately set. As the result of checking, when the normal operation period has also been accurately set, it means that the pump is currently close to a failure, the operator performs a precise examination.

When it is also determined that the pump speed is stable while the operator performs monitoring in accordance with the result of the process described above, it is possible to determine that the pump currently is in abnormal state. In this case, the failure types stated to now may be classified into two types in a broad meaning in accordance with the change aspect of a scaled load ratio, and are as follows.

The first case is that a scaled load ratio suddenly shows a large change. In this case, when it has been determined that it is not a fluid pound, it is possible to determine that it is a rapid change due to a worn pump in most cases. It means that the scaled load ratio has been changed because the pump does not function properly at the same speed due to aging or sudden damage, which corresponds to a first level-pump abnormality aspect showing a severe failure of the pump.

The second case is a scaled load ratio that gradually changes and comes out of the normal range. This phenomenon usually occurs when a pump fillage gradually decreases. If a pump fillage continuously decreases even though the pump speed is maintained at a similar level, there is a high possibility of a malfunction of the rod pump, and precise diagnosis is required.

Five factors influence the determination result during the process of determining a pump state. The five factors are 1) the size of a rolling window that is used to remove noise, 2) the upper limit of the normal range of a scaled load ratio (scaled load ratio upper bound), 3) the lower limit of the normal range of a scaled load ratio (load ratio lower bound), 4) an alert period used for a final result after a pump state is determined, that is, a reference period for predicting a failure of a pump, and 5) an alert frequency ratio for an abnormal state of the pump in the alert period.

The functions of the five factors affect the value of a calculated scaled load ratio and a pump state using the value.

That is, when the size of a rolling window is excessively small, noise cannot be effectively removed, but when it is excessively large, the rolling window dully reacts to an outlier that is not noise. Accordingly, it is required to set a value at which noise is effectively removed but an appropriate sensitivity is secured for an outlier.

The upper limit and the lower limit of the normal range of a scaled load ratio are values that are direct references, so when the limits are set excessively close to 1, a pump that is being normally operated is misjudged as being in a dangerous state in more cases.

It is determined that a pump is in an abnormal state on the basis of how much continuity or frequency a scaled load ratio out of a normal range has, depending on what values are set as an alert period and an alert frequency ratio for determining pump failures.

That is, it is required to appropriately set the five factors in order to achieve a desired determination result in monitoring that uses a scaled load ratio. Accordingly, the present disclosure includes the optimization step S101 described above which optimizes the five factors (i.e., variables) in the optimization module 67 shown in FIG. 5 and constituting the software 60 by setting the five factors as five variables. The purpose of the optimization is to set the five factors to examine oil wells close to an abnormal state as many as possible when an operator (e.g., a user) at the site determines an intention using the finally calculated determination result.

Hereafter, as an example, a process related to the optimization step S101 of optimizing five factors set as five variables, as described above, through the optimization module 67 is described in detail with reference to a certain target oil well field.

Meanwhile, the 34 temporal datasets (e.g., 31 pump abnormality periods and 3 normal operation periods) were used to optimize the five input variables in the optimization step S101.

In general, an objective function that a computer processor (e.g., the processor 30 shown in FIG. 4) calculates must be provided to apply an optimization algorithm. Matthews Correlation Coefficient (MCC) (Matthews, 1975) was used as the objective function in the optimization algorithm. MCC is given in Equation (3).

$$MCC = \frac{TP \times TN - FP \times FN}{\sqrt{(TP + FP)(TP + FN)(TN + FP)(TN + FN)}} \tag{3}$$

In Equation 3, TP is a true-positive frequency, TN is a true-negative frequency, FP is a false-positive frequency, and FN is a false-negative frequency.

Further, in the Equation (3), true and false in TP, TN, FP, and FN imply that a pump failure happens and a pump failure does not happen (eg. normal state), respectively. Positive and negative in TP, TN, FP, and FN imply the correct and incorrect predictions, respectively.

For example, TP means that a pump is in a failure state and the prediction is correct. TN means that a pump is in a failure state and the prediction is incorrect. FP means that a pump is in a normal state and the prediction is correct. FN means that a pump is in the normal state and the prediction is incorrect. MCC is a value calculated by the Equation (3) by adding up the number of TP, FP, TN, and FN of the evaluated data.

MCC, which ranges from −1 to 1, is 1 when all predictions are correct, and MCC is −1 when all prediction are wrong. As MCC is close to 0, it means that the classification result is randomly.

Two things were modified in MCC shown in Equation (3) to solve unusual problems in predicting pump failures. First, rod pumps are mostly in normal states. In other words, the number of data points under the normal states is significantly higher than the number of data points under pump failures. If the original MCC is used, the five input variables are adjusted in the optimization so that the normal states (eg. FP) are predicted more correctly than TP. Thus the original MCC was modified so TP is forced to be more weighted. In Equation (4), the modified MCC gives a weight of five to TP. Second, once a single pump failure event occurs and sufficient data points are classified as pump failures after the pump failure event, a reliable alert can be delivered to operators. Thus, if the number of TP data points is greater than 10% of the number of the entire data points under the pump failure event, all the data points under the pump failure event are considered as TP regardless of the prediction results.

The two rules are final rules on the basis of various attempts and feedback of a result from an operator at the site. MCC obtained by applying the two rules was named a modified MCC, which is expressed as the following Equation (4). The modified MCC was obtained for 34 periods and the average modified MCC of the 34 periods was used as a final objective function. In this case, the objective function means the average value of the modified MCCs of the periods.

$$MCC_{modified} = \frac{5 \times TP \times TN - FP \times FN}{\sqrt{(5 \times TP + FP)(5 \times TP + FN)(TN + FP)(TN + FN)}} \quad (4)$$

As for the alert period, a wide range of 0.1 day to 14 days was designated as a search target at the early stage of attempting optimization. However, the alert period may be converged to the lower or upper bounds in the optimization because of the proportions of normal and abnormal data points. In this case, the period of pump data acquisition is a good reference value for the alert period. For example, if pump data are acquired every day, 1 day may be set as the alert period.

Particle Swarm Optimization (PSO) (Kennedy and Eberhart, 1995) is used to find the optimal five input variables maximizing the modified MCC. PSO is an algorithm that finds out an optimal solution by repeating a process of selecting several solution candidate groups in a set of solutions and then selecting a next candidate group by adjusting the variables of the above candidate groups to find out a solution having a best objective function value. In the present disclosure, the algorithm was applied using 100 candidate groups and 0.001 as the minimum change of the objective function average for convergence. The range of the variables used in the algorithm is the same as the range of variables set to predict a pump failure using the load ratio shown in Table 2.

TABLE 2

| variable | range of variable | |
|---|---|---|
| | lower limit | upper limit |
| size of rolling window | 0 | 2 |
| upper limit of load ratio | 1 | 2 |
| lower limit of load ratio | 0.5 | 1 |
| alert period | 1 | 1 |
| alert frequency ratio | 0 | 1 |

The optimization result for the above procedure is given in Table 3.

TABLE 3

| variable | Value |
|---|---|
| size of rolling window | 0.1006(Day) |
| upper limit of load ratio | 1.0571 |
| lower limit of load ratio | 0.8886 |
| alert period | 1(Day) |
| alert frequency ratio | 0.11 |

The range of the variables is set to predict a pump failure using the scaled load ratio used in the optimization algorithm (PSO) for optimization, and the optimal five variables optimized are also stored in the storage device 20 shown in FIG. 4.

The accuracy for the 34 periods was measured on the basis of whether an operator can recognize pump failures easily. The prediction succeeded for the 26 periods of the 34 periods and it failed for the 8 periods. The result is given shown in Table 4. A pump failure was correctly predicted before as long as 1 month and as short as 2-3 days. Because the result for all the 34 periods may be changed depending on fields, the detailed prediction result was not shown here.

TABLE 4

| | prediction result |
|---|---|
| succeeding prediction | 26 of 34 |
| failed prediction | 8 of 34 |
| ratio of succeeding prediction | 76.4% |

The characteristics of predicting a pump failure using a scaled load ratio can be seen from the graphs exemplifying two prediction results shown in FIGS. 2A and 2B and FIGS. 3A and 3B, respectively.

Figure 2A:
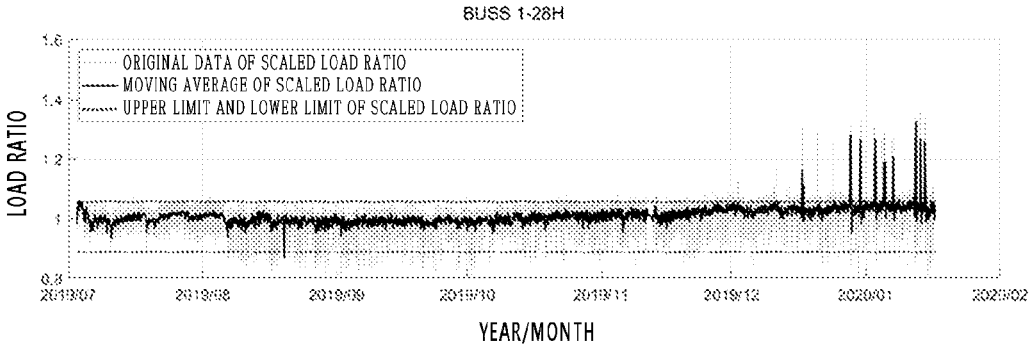
FIGS. 2A and 2B are exemplary graphs showing the result of predicting failures of rod pumps using scaled load ratios according to the present disclosure.
Figure 3A:
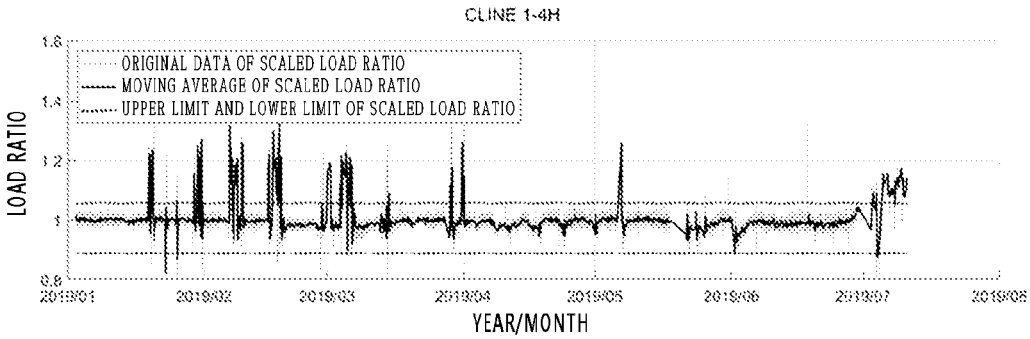
FIGS. 3A and 3B are other exemplary graphs showing the result of predicting failures of rod pumps using scaled load ratios according to the present disclosure.

In the graphs shown in FIGS. 2A and 3A, the gray part shows a scaled load ratio drawn as time passes after an outlier is removed, that is, the original data of scaled load ratios, the black part shows load ratios with noise removed by applying a rolling window method, that is, the moving average of scaled load ratios, and the upper and lower dotted lines in the graphs show the upper limit and lower limit of the scaled load ratio that are boundaries of a normal range, that is, the upper limit and lower limit of scaled load ratio.

Figure 2B:
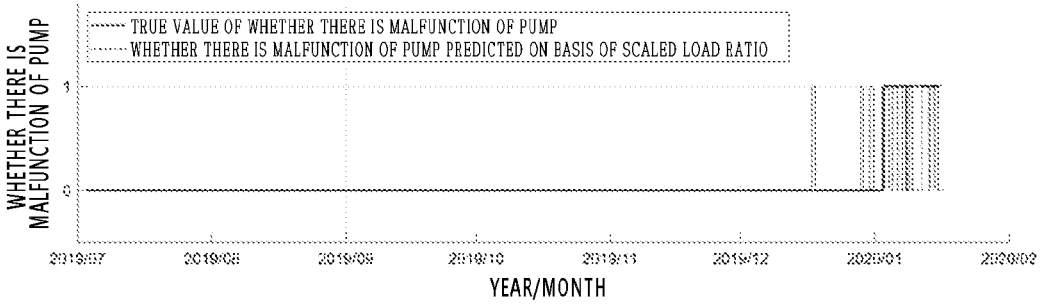
Figure 3B:
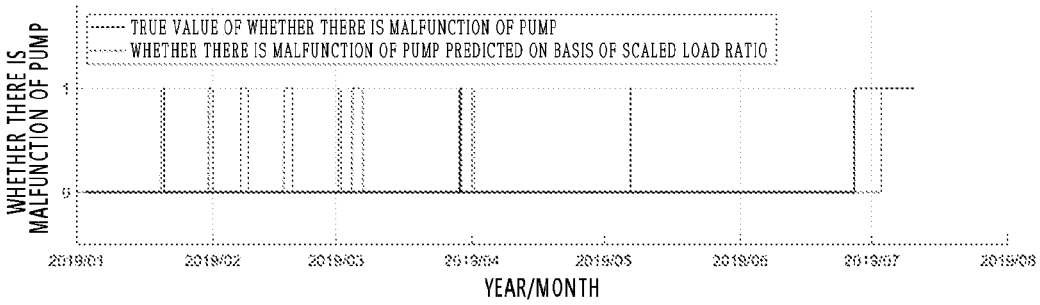

In the graphs shown in FIGS. 2B and 3B, the black part shows a true value that a module was supposed to predict, that is, a true value of whether there is a failure of a pump, and the dotted line shows a prediction result using a scaled load ratio, that is, whether there is a failure of a pump predicted on the basis of a scaled load ratio.

The characteristics of the prediction result of the first example can be seen from the prediction result graph of the oil well field of FIGS. 2A and 2B (e.g., BUSS 1-28H field) that was predicted well.

The graph of FIG. 2B shows the result when the reference was applied, in which the black part, as described above, shows a true value that a module was supposed to predict. The period depends on oil wells and is as little as 1 week and as long as 1 month. As described above, the dotted line shows a prediction result using a load ratio. It is 1 for a pump failure and 0 for a normal operation state.

The characteristics of the prediction result in the second example can be seen from the prediction result graph of the oil well field (e.g., CLINE 1-4H field) of FIGS. 3A and 3B which is a well predicted result but requires discrimination of the case close to an actual pump failure using a pump speed and a pump fillage.

Referring to the result shown in FIG. 3B, the data after July which are close to a pump failure are classified right as a pump failure, so it is possible to take measures before 5 days from occurrence of a severe pump failure. However, data classified as a pump failure may be observed before July. In this period, a pump is operated temporarily at a very low pump speed because a pump-off controller is operated due to a temporal low pump fillage. In this period, the scaled load ratio comes out of the normal operation period, but the pump fillage does not cause a severe pump failure within a short period, so an operator should make a decision using prior knowledge about the pump against such a short pump failure signal.

As a result, the upper limit of a normal range of a scaled load ratio, the lower limit of the normal range of the scaled load ratio, the alert period, and the alert frequency ratio that are finally set in the optimization are used, the prediction succession ratio is 76.4% for the exemplified 34 periods and this value is enough to be used as a primary pump monitoring index when several pumps are simultaneously operated at a site. Accordingly, as in the present disclosure, by primarily detecting a pump predicted to have a pump failure using a scaled load ratio and then performing precise analysis, it is possible to effectively manage several oil well pumps with less manpower, cost, and time.

Meanwhile, the method described above may be implemented by general logical connection of instructions that are executed by a computer. Such computer-executable instructions may include a program, a routine, an object, a component, a data structure, and a computer software technology that can be used to perform specific work and process abstract data types. The software of the method may be coded by different languages to be used in various computing platforms and environments. It should be understood that the range and fundamental principle of the method are not limited to a certain specific computer software technology.

Those skilled in the art, though not limited, would recognize that the method can be achieved by certain one of a single or multiple processor system, a portable device, a programmable consumer electronic device, and a computer processing system including a mini-computer or a main frame computer, or a combination thereof. The method may also be achieved in a distribution computing environment in which work is performed by a server or another processing device linked through one or more data communication network. In the distribution computing environment, software may be provided for all of local and remote computer storage media including a memory storage device.

Further, products that are used with a computer processor, such as a CD, a pre-recorded disc, or other equivalent devices, may include a computer program storage medium and a program recorded thereon to give instructions to a computer processor in order to easily achieve and perform the method. Such devices and products are included in the spirit and range of the present disclosure.

As described, it should be noted that the present disclosure can be achieved in various ways including a data structure tangibly fixed, for example, in a method (including a computer implementation method), a system (including a computer processing system), a device, a computer-readable medium, a computer program product, a graphic interface, a web portal or computer-readable memory.

Hereafter, the system 10 for predicting a failure of a rod pump using a scaled load ratio in which the method is implemented is described in detail with reference to FIG. 4.

As shown in FIG. 4, the system 10 includes a storage device 20, a processor 30, a sensor 40, an interface 50, and software 60 that can communicate with each other through a wire/wireless communication network.

The communication network, for example, includes a switch in a computer, a Personal Area Network (PAN), a Local Area Network (LAN), a Wide Area Network (WAN), and a Global Area Network (GAN), but is not limited thereto. The communication network may include a certain hardware network that is used to connect an optical cable or an individual device of a network such as a wireless frequency.

The interface 50 of the system 10 enables an operator to actively input various data into the storage device 20 and check the operation information of the system 10. In general, the interface 50, though not limited, may be a certain device that enables an operator to interact with the system 10, such as a keyboard, a mouse, or a display (e.g., all displays including a touch screen).

The processor 30 of the system 10 for predicting a failure of a pump is configured to receive data of the current maximum load on a surface rod, the current minimum load on the surface rod, the current pump speed of a pump stored in the storage device 20 through the communication network, and to execute the software 60 in response to the data.

The sensor 40 of the system 10 for predicting a failure of a pump is installed at each oil well field and is configured to receive data of the current maximum load on a surface rod, the current minimum load on the surface rod, the current pump speed of a pump, and to store the received data in the storage device 20 through the communication network.

Various obtained and created data can be stored in the storage device 20, that is, various values (e.g., an oil well sensor measurement value showing production and oil well states) may be stored through a load cell, a motor sensor, a transducer, and a relay.

The software 60 that performs the steps described above in accordance with instructions from the processor 30 through the communication network includes the outlier removal module 61, the scaling module 62, the scaled load ratio calculation module 63, the scaled load ratio average value calculation module 64, the scaled load ratio-normal range determination and classification module 65, the failure data ratio calculation and alert generation module 66, and the optimization module 67, which are shown in FIG. 5.

The outlier removal module 61 constituting the software 60 is configured to remove an outlier showing an abnormality of the data received by the processor 30 from the storage device 20 on the basis of an outlier removal reference set as in Table 1.

The processor 30 receives data of a maximum load on a surface rod in normal operation and a minimum load on a surface rod in normal operation, which are stored in the storage device 20 through the interface 50 by an operator, and scales the data into normal operation values through the scaling module 62. The data of a maximum load on a surface rod in normal operation and a minimum load on a surface rod in normal operation are average values for about 2 weeks of a period in which a pump is normally operated, depending on target oil wells.

The scaled load ratio calculation module 63 constituting the software 60 is configured to calculate a scaled load ratio using data that have undergone preprocesses such as the outlier removal and scaling through the scaled load ratio calculation Equation (1).

The scaled load ratio average value calculation module 64 constituting the software 60 is configured to calculate the average value of load ratios within a certain predetermined period by applying a rolling window method to remove noise from the calculated scaled load ratio, and the calculated average value of the scaled load ratios is stored in the storage device 20 through the communication network.

The scaled load ratio-normal range determination and classification module 65 constituting the software 60 is configured to determine whether the scaled load ratio with noise removed is a value in a normal range, to classify the scaled load ratio as normal when it is a value in the normal range, and to classify the scaled load ratio as failure when it is a value out of the normal range. The normal range may be divided into an upper limit and lower limit, which may be changed in accordance with the data of a field and a desired sensitivity.

The failure data ratio calculation and alert generation module 66 constituting the software 60 is configured to calculate the ratio of actual range values (i.e., to calculate the ratio of the failure data in a certain predetermined period) using the normal/failure data classified as described above, and to determine that there is a pump failure and to generate an alert when the ratio exceeds a predetermined ratio. The alert can be delivered using certain device (though not shown, for example, a printer, a speaker, a display screen, or a data storage device) that communicates with the failure data ratio calculation and alert generation module 66 through the communication network.

Thereafter, an operator takes appropriate measures for the corresponding pump by performing monitoring for accurately determine the state of the pump, as described above, on the basis of the scaled load ratio calculated through the system and a pump state value predicted using the scaled load ratio.

That is, in order to accurately determine a pump state using a pump speed, a pump card, and a pump Pillage together with the calculated scaled load ratio, an operator monitors a pump state through the system 10 for predicting failure of a pump.

In order to obtain a desired determination result when monitoring using the scaled load ratio, as described above, the five factors described above, that is, 1) the size of a rolling window that is used to remove noise, 2) the upper limit of the normal range of a scaled load ratio, 3) the lower limit of the normal range of a scaled load ratio, 4) an alert period used for final conclusion after a pump state is determined, and 5) an alert frequency ratio of a pump abnormal state in an alert period should be appropriately set.

To this end, the optimization module 67 constituting the software 60 is configured to optimize the five factors by setting the five factors (the size of a window, the upper limit of the normal range of a scaled load ratio, the lower limit of the normal range of a scaled load ratio, the alert period, and the alert frequency ratio) as five variables.

The optimization may be performed when the size of a rolling window, the upper limit of a normal range of a scaled load ratio, the lower limit of the normal range of the scaled load ratio, the alert period, and the alert frequency ratio are initially set as optimal initial input values (e.g., initial values of variables), or may be performed when an operator resets the size of a rolling window, the upper limit of a normal range of a scaled load ratio, the lower limit of the normal range of the scaled load ratio, the alert period, and the alert frequency ratio as more accurate new optimal input values during monitoring.

That is, the optimization is performed not every time the system of the present disclosure is operated, and the optimization may be performed when initial input values are initially set, or may be selectively performed, if necessary, depending on situations.

The size of a rolling window, the upper limit of a normal range of a scaled load ratio, the lower limit of the normal range of the scaled load ratio, the alert period, and the alert frequency ratio that are the optimal input values set through the optimization are stored in the storage device.

In order for the optimization module 67 to perform optimization, there is a need for an objective function that the processor 30 can easily calculate, and the objective function means the average value of modified MCC of analysis periods.

An MCC that is one of analysis performance evaluation indexes for classifying data of analysis periods into data close to a pump abnormal state and data not close to it was used to calculate the objective function, and is calculated by the above Equation (3).

Meanwhile, as described above, two factors are changed in the Equation for calculating an MCC so that a prediction result useful to help actual determination by an operator is evaluated high when an objective function is calculated using the MCC. That is, first, a weight of 5 is given to TP and an MCC is calculated so that the optimized condition attaches importance to TP, and second, when TP is over 10% of the entire TF data, the other TF data are all classified as TP. A modified MCC to which this process is applied is as the above Equation (4). The modified MCCs of analysis periods calculated through Equation (4) are selected as objective functions, and the average value of the modified MCC of the analysis periods is selected as a final objective function.

The optimization algorithm used by the optimization module 67 to calculate the modified MCCs as objective functions is Particle Swarm Optimization (PSO) described above.

As for the alert period of each of the analysis periods, a wide range of 0.1 day to 14 days is designated as a search target at the early stage of attempting optimization by the optimization module 67, but is fixed as 1 day when final optimization is performed.

Since pump data were obtained with an interval of 1 day, as described above, the alert period is fixed as 1 day and only the other four components are optimized during the final optimization by the optimization module 67.

As described above, the range of the variables set to predict a pump failure using the scaled load ratio used in the optimization algorithm (PSO) for optimization by the optimization module 67, and the input values of the five variables optimized to predict a pump failure using the finally determined scaled load ratio are stored in the storage device 20 shown in FIG. 4.

Meanwhile, as shown in FIG. 4, the data stored in the storage device 20 of the present disclosure, in the above description, are sensor detection data, outlier removal reference data, the maximum load on a surface rod and the minimum load on a surface rod in normal operation, an average value of load ratios, the range of variables set to predict a pump failure, and input values of five variables optimized to predict a pump failure, but are not limited thereto.

Further, as shown in FIG. 5, it was exemplified that the software 60 used in the present disclosure includes the outlier removal module 61, the scaling module 62, the scaled load ratio calculation module 63, the scaled load ratio average value calculation module 64, the scaled load ratio-normal range determination and classification module 65, the failure data ratio calculation and alert generation module 66, and the optimization module 67, but is not limited thereto.

Further, the system 10 includes a computer program product or software 60 stored in a processor-readable medium. As a current example, the processor-readable medium includes an electronic circuit, a semiconductor storage device, a ROM, a flash memory, an EPROM (Erasable Programmable ROM), a floppy diskette, a compact disc (CD-ROM), an optical disc, a hard disc, and an optical fiber medium, but is not limited thereto. As described more completely in this specification, the software 60 may include a plurality of modules for performing system work like performing a method the same as the process described above. The processor 30 not only analyzes instructions for executing the software 60, but creates automatic instructions for executing software for the system 10 in response to predetermined conditions. Instructions from the interface 50 and the software 60 are processed by the processor 30 to operate the system 10.

Although the present disclosure was described in detail with reference to detailed embodiments, the embodiments are provided only to describe the present disclosure in detail and the present disclosure is not limited to the embodiments. Further, it is apparent that the present disclosure may be changed and improved by those skilled in the art without departing from the spirit of the present disclosure.

Simple changes and modifications of the present disclosure are included in the range of the present disclosure and the detailed protection range of the present disclosure will be made clear by the following claims.

What is claimed is:

1. A method of predicting pump failures of rod pumps using a scaled load ratio, the method comprising:

optimizing a size of a rolling window, upper and lower bounds of a normal range of the scaled load ratio, an alert period, and an alert frequency ratio as optimal input values through an optimization module constituting software;

receiving data of a current maximum load on a surface rod, a current minimum load on the surface rod, and a current speed of a target oil well pump from a storage device by means of a processor of a pump failure prediction system;

removing outliers from the received data on the basis of an outlier removable reference set using an outlier removable module constituting the software that is executed by the processor to generate filtered data;

receiving data of maximum and minimum loads on the surface rod in normal operation from the storage device and scaling the maximum and minimum loads by means of the processor;

calculating scaled load ratios using a scaled load ratio calculation module constituting the software using the filtered data;

calculating an average of the scaled load ratios in the rolling window using a scaled load ratio through average value calculation module constituting the software by applying a rolling window method to remove noises of the scaled load ratios;

determining whether the average of the scaled load ratios is in the normal range, and classifying the scaled load ratios as normal events or abnormal events using a scaled load ratio-normal range determination and classification module constituting the software;

calculating a ratio of the abnormal events and generating an alert when the ratio of the abnormal events exceeds the alert frequency ratio using a failure data ratio calculation and alert generation module constituting the software; and monitoring a pump state using the pump failure prediction system to accurately predict the pump failures using the scaled load ratios, a pump speed, a pump card, and a pump fillage.

2. The method of claim 1, wherein the optimizing is performed when the size of the rolling window, the upper and lower bounds of the normal range of the scaled load ratio, the alert period, and the alert frequency ratio are initially set as the optimal input values, or is performed when a rod pump is reinstalled, repaired, or replaced.

3. The method of claim 1, wherein the size of the rolling window, the upper and lower bounds of the normal range of the scaled load ratio, the alert period, and the alert frequency ratio that are the optimal input values set using the optimization module are stored in the storage device.

4. The method of claim 1, wherein a Matthews Correlation Coefficient (MCC) that is an index for evaluating analysis performance is used in an objective function that is used for optimization during the optimizing, and the MCC is calculated by Equation 3, $$MCC = \frac{TP \times TN - FP \times FN}{\sqrt{(TP + FP)(TP + FN)(TN + FP)(TN + FN)}} \tag{3}$$

wherein TP is a true-positive frequency, TN is a true-negative frequency, FP is a false-positive frequency, and FN is a false-negative frequency.

5. The method of claim 4, wherein a modified MCC is calculated by Equation 4 by applying a condition of calculating the MCC by giving a weight of 5 to the TP so that an optimized condition attaches importance to the TP, and a condition of classifying TF (true false) data as the TP when the TP is over 10% of the TF data, and an optimization algorithm used for optimization when the modified MCC is the objective function is a Particle Swarm Optimization (PSO), $$MCC_{modified} = \frac{5 \times TP \times TN - FP \times FN}{\sqrt{(5 \times TP + FP)(5 \times TP + FN)(TN + FP)(TN + FN)}} \tag{4}$$

6. The method of claim 1, wherein as for the alert period, a range of 0.1 day to 14 days is designated as a search target at an early stage of attempting optimization, and is fixed as 1 day when final optimization is performed.

7. The method of claim 1, wherein for the data of the maximum/minimum loads on the surface rod in the normal operation, average values for 2 weeks of a production period that is stably maintained are used, depending on target oil well fields, or theoretical maximum/minimum loads in the normal operation are used when there are target oil well, pump, and production liquid.

8. The method of claim 1, wherein the scaled load ratio is calculated by Equation 1 and 2

$$\text{Scaled minimum load on surface rod} = \frac{\text{Current minimum load on surface rod}}{\text{Minimum load on surface rod in normal operation}} \tag{1}$$

$$\text{Scaled minimum load on surface rod} = \frac{\text{Current maximum load on surface rod}}{\text{Maximum load on surface rod in normal operation}}$$

$$\text{Scaled load ratio} = \frac{\text{Scaled minimum load on surface rod}}{\text{Scaled maximum load on surface rod}} \tag{2}$$

9. A system for predicting failures of rod pumps using a scaled load ratio, the system comprising:

a storage device storing data in the system, the data comprising current maximum/minimum loads on a surface rod, a current pump speed obtained from a sensor installed at a rod pump, scaled load ratios, an average of the scaled load ratios in a rolling window, a ratio of abnormal events, a size of the rolling window, upper and lower bounds of a normal range of the scaled load ratio, an alert period, and an alert frequency ratio; and a processor executing software using the data stored in the storage device, wherein the software predicts whether the rod pump has an abnormality by calculating the scaled load ratio on the basis of the current maximum/minimum loads on the surface rod stored in the storage device and data of maximum/minimum loads on the surface rod in normal operation.

10. The system of claim 9, wherein the software includes an outlier removable module configured to remove outliers from the data received by the processor from the storage device on the basis of a set outlier removal reference.

11. The system of claim 10, wherein the software includes a scaled load ratio calculation module configured to calculate the scaled load ratio using data that have undergone preprocesses such as outlier removal and scaling.

12. The system of claim 11, wherein the software includes a scaled load ratio average calculation module configured to calculate the average the scaled load ratios in the rolling window by applying a rolling window method to the scaled load ratio to remove noises of the scaled load ratio.

13. The system of claim 12, wherein the software includes a scaled load ratio-normal range determination and classification module configured to determine whether the average of the scaled load ratios is in the normal range, and classify the scaled load ratios as normal events and abnormal events.

14. The system of claim 13, wherein the software includes a failure data ratio calculation and alert generation module configured to calculate a ratio of the abnormal events in the alert period, and to generate an alert when the ratio of the abnormal events exceeds the alert frequency ratio.

15. The system of claim 12, wherein the software further includes an optimization module configured to optimize the size of the rolling window, the upper and lower bounds of the normal range of the scaled load ratio, the alert period, and the alert frequency ratio as optimal input values;

wherein the optimization is performed when the size of the rolling window, the upper and lower bounds of the normal range of the scaled load ratio, the alert period, and the alert frequency ratio are initially set as the optimal input values, or is performed when a rod pump is reinstalled, repaired, or replaced; and wherein the size of the rolling window, the upper and lower bounds of the normal range of the scaled load ratio, the alert period, and the alert frequency ratio that are the optimal input values set in the optimization module are stored in the storage device.

16. The system of claim 15, wherein a Matthews Correlation Coefficient (MCC) that is an index for evaluating analysis performance is used in an objective function that is used during optimization by the optimization module, and the MCC is calculated by Equation 3, $$MCC = \frac{TP \times TN - FP \times FN}{\sqrt{(TP + FP)(TP + FN)(TN + FP)(TN + FN)}} \tag{3}$$

wherein TP is a true-positive frequency, TN is a true-negative frequency, FP is a false-positive frequency, and FN is a false-negative frequency.

17. The system of claim 16, wherein a modified MCC is calculated by Equation 4 by applying a condition of calculating the MCC by giving a weight of 5 to the TP so that an optimized condition attaches importance to the TP, and a condition of classifying TF (true false) data as the TP when the TP is over 10% of the TF data, and an optimization algorithm used for optimization when the modified MCC is the objective function is a Particle Swarm Optimization (PSO), $$MCC_{modified} = \frac{5 \times TP \times TN - FP \times FN}{\sqrt{(5 \times TP + FP)(5 \times TP + FN)(TN + FP)(TN + FN)}} \tag{4}$$

18. The system of claim 15, wherein as for the alert period, a range of 0.1 day to 14 days is designated as a search target at an early stage of attempting optimization, and is fixed as 1 day when final optimization is performed.

19. The system of claim 9, wherein the software includes a scaling module configured to receive data of maximum/minimum loads on the surface rod input and stored in the storage device by an operator via an interface, and to scale the data of the maximum/minimum loads on the surface rod into normal operation values to generate the data of the maximum/minimum loads on the surface rod in the normal operation.

20. The system of claim 19, wherein for the data of the maximum/minimum loads on the surface rod in the normal operation, average values for 2 weeks of a production period that is stably maintained are used, depending on target oil well fields, or theoretical maximum/minimum loads in the normal operation are used when there are target oil well, pump, and production liquid.

* * * * *